US009458687B2

(12) United States Patent
Hallundbæk

(10) Patent No.: US 9,458,687 B2
(45) Date of Patent: Oct. 4, 2016

(54) STIMULATION METHOD

(71) Applicant: WELLTEC A/S, Allerød (DK)

(72) Inventor: Jørgen Hallundbæk, Græsted (DK)

(73) Assignee: WELLTEC A/S, Allerød (DK)

( * ) Notice: Subject to any disclaimer, the term of this patent is extended or adjusted under 35 U.S.C. 154(b) by 11 days.

(21) Appl. No.: 14/362,674

(22) PCT Filed: Dec. 20, 2012

(86) PCT No.: PCT/EP2012/076288

§ 371 (c)(1),
(2) Date: Jun. 4, 2014

(87) PCT Pub. No.: WO2013/092804

PCT Pub. Date: Jun. 27, 2013

(65) Prior Publication Data

US 2014/0352947 A1 Dec. 4, 2014

(30) Foreign Application Priority Data

Dec. 21, 2011 (EP) ..... 11195003

(51) Int. Cl.
*E21B 43/116* (2006.01)
*E21B 28/00* (2006.01)
(Continued)

(52) U.S. Cl.
CPC ..... *E21B 28/00* (2013.01); *E21B 43/003* (2013.01); *E21B 43/116* (2013.01); *E21B 43/16* (2013.01); *E21B 43/25* (2013.01); *E21B 43/281* (2013.01); *E21B 47/10* (2013.01); *E21B 47/122* (2013.01)

(58) Field of Classification Search
CPC ..... E21B 43/117; E21B 43/1185; E21B 43/116; E21B 43/119; E21B 43/11852; E21B 43/1195; E21B 43/26; E21B 29/02; E21B 47/122; E21B 43/263
See application file for complete search history.

(56) References Cited

U.S. PATENT DOCUMENTS 6,065,538 A * 5/2000 Reimers ..... E21B 23/03 166/250.01
6,268,911 B1 * 7/2001 Tubel ..... E21B 23/03 250/256

(Continued)

FOREIGN PATENT DOCUMENTS

CN 1094118 A 10/1994
CN 101057058 A 10/2007

(Continued)

OTHER PUBLICATIONS

International Search Report for PCT/EP2012/076288 mailed Mar. 4, 2013.

(Continued)

*Primary Examiner* — Zakiya W Bates
(74) *Attorney, Agent, or Firm* — Nixon & Vanderhye P.C.

(57) ABSTRACT

A method for improving fuel collection from an underground deposit comprising stimulating fuel-containing sections of an underground formation, the sections being located between a first well and a second well, the first well being either an injection well or a production well, and the second well being a production well. The method includes arranging a mechanical wave generation device downhole in the first well and arranging at least a first mechanical wave sensor in the production well, injecting a pressurized fluid into the formation from at least the first well, activating the mechanical wave generation device downhole to project mechanical waves into and through the fuel-containing sections, receiving and processing the waves sent from the first well, generating a tomography of the underground environment between the first well and the second well, and collecting fuel in the second well via inflow valves arranged in the second well.

22 Claims, 4 Drawing Sheets

(51) Int. Cl.

| | |
|---|---|
| ***E21B 43/00*** | (2006.01) |
| ***E21B 43/16*** | (2006.01) |
| ***E21B 43/25*** | (2006.01) |
| ***E21B 43/28*** | (2006.01) |
| ***E21B 47/10*** | (2012.01) |
| *E21B 47/12* | (2012.01) |

(56) References Cited

U.S. PATENT DOCUMENTS

| | | | |
|---|---|---|---|
| 2005/0189108 | A1 | 9/2005 | Davidson |
| 2006/0096752 | A1 | 5/2006 | Arnoldo et al. |
| 2011/0139440 | A1 | 6/2011 | Zolezzi-Garreton |
| 2012/0055685 | A1 | 3/2012 | Sanders et al. |
| 2012/0106292 | A1 | 5/2012 | Fuller et al. |
| 2012/0318499 | A1 | 12/2012 | Sanders et al. |

FOREIGN PATENT DOCUMENTS

| | | |
|---|---|---|
| CN | 101571041 A | 11/2009 |
| WO | WO 2011/146827 | 11/2011 |
| WO | WO 2011/156788 | 12/2011 |

OTHER PUBLICATIONS

International Preliminary Report on Patentability for PCT/EP2012/076288, mailed Nov. 28, 2013.

Notification of the First Office Action dated Apr. 15, 2016 issued in Chinese Application No. 201280060380.7 with English translation (17 pages).

* cited by examiner

STIMULATION METHOD

This application is the U.S. national phase of International Application No. PCT/EP2012/076288 filed 20 Dec. 2012 which designated the U.S. and claims priority to EP Patent Application No. 11195003.6 filed 21 Dec. 2011, the entire contents of each of which are hereby incorporated by reference.

FIELD OF THE INVENTION

The present invention relates to a stimulation method for stimulating oil- or gas-containing parts of a formation and to a downhole stimulation system.

BACKGROUND ART

Geophysical surveys are used to discover the extent of subsurface mineral reservoirs such as reservoirs of oil, natural gas, water, etc. Geophysical methods may also be used to monitor changes in the reservoir, such as depletion resulting from production of the mineral over the natural lifetime of the deposit, which may be many years. The usefulness of a geophysical study depends on the ability to quantitatively measure and evaluate some geophysical analogue of a petrophysical parameter that is directly related to the presence of the mineral under consideration.

Effectively searching for oil and gas reservoirs often requires imaging of the reservoirs using two-, three- or four-dimensional mechanical wave data (with the fourth dimension being time). Mechanical waves may be applied and recorded at the surface or in wells, and an accurate model of the underlying geologic structure may be constructed by processing the data obtained from such mechanical waves in a formation. Imaging a formation by means of such data is a computationally intensive task, and typically application of mechanical waves downhole or uphole in wells drilled under water presents an expensive and tedious task for the oil and gas industry. However, relevant information obtained by such measurements may result in significant increases in the recovery of oil from oil fields due to increased knowledge of the formation that can be used to shape the strategy for draining the reservoir, and therefore the method is also of great value.

Furthermore, seismic or mechanical waves used for oil field stimulation is a known technique for enhancing oil recovery from an oil-bearing bed. As the waves pass through the formations in the ground, they cause particles of rock to move in different ways, pushing and pulling the rock.

Conventionally, seismic imaging is performed from the surface. However, well-to-well imaging has shown to be much more efficient. However, performing such imaging analysis of the formation using well-to-well techniques is not widely used in the oil fields even though it has proven to be efficient. It is only used as a probing technique in a few selected wells.

SUMMARY OF THE INVENTION

It is an object of the present invention to wholly or partly overcome the above disadvantages and drawbacks of the prior art. More specifically, it is an object to provide an improved method of extracting oil- or gas-containing fluid from a reservoir.

The above objects, together with numerous other objects, advantages, and features, which will become evident from the below description, are accomplished by a solution in accordance with the present invention by a stimulation method for stimulating oil- or gas-containing parts of a formation, said parts being situated between an injection or a production well and a production well, and the method comprising the steps of:

- arranging at least one mechanical wave activation device in one or more injection and/or production wells below a well head or a blowout preventer for transmitting mechanical waves from one or more injection wells and/or production wells,
- arranging a plurality of mechanical wave sensors in one or more injection or production wells for receiving the mechanical waves transmitted from the mechanical wave activation device,
- injecting a pressurised fluid into the formation from the one or more injection wells towards the one or more production wells,
- activating the mechanical wave activation device with a preselected range of frequencies or a single frequency, thereby converting energy from the pressurised fluid into mechanical waves,
- receiving the mechanical waves transmitted by the mechanical wave activation device through the formation by the plurality of mechanical wave sensors, and
- creating a tomography of water, gas and/or oil interfaces in the part of the formation situated between the mechanical wave activation device in the injection and/or production well and the mechanical wave sensor in the at least one injection and/or production well from the mechanical wave received by the plurality of mechanical wave sensors arranged in the at least one injection and/or production well.

In an embodiment, the mechanical wave activation device may be mechanical wave activation means in which the means is a physical entity and not a fluid or chemical substance.

Also, the mechanical wave sensor may be a mechanical wave sensor means in which the means is a physical entity.

Moreover, the mechanical wave activation device may be activated by means of pressurised fluid, explosives or detonations, a motor, a chemical composition or solid fuel.

Further, the mechanical wave activation device may be a downhole perforation gun, a fluid-activated gun, a seismic source, a chemical reaction gun or a solid fuel gun. The gun may be an electromagnetic hammer.

Additionally, the perforation gun may be a non-perforating gun comprising non-perforating charges.

In one embodiment, the mechanical wave activation device may be arranged in the injection well.

Furthermore, the mechanical wave sensor may be arranged in the production well.

The injection well and/or the production well may be inside or in a proximity of the oil- or gas-containing parts of the formation.

Said stimulation method may further comprise the step of transmitting information to a user of the tomography of water, gas and/or oil interfaces in the part of the formation situated between the mechanical wave activation device in the injection and/or production wells and the mechanical wave sensor in the at least one injection and/or production well in order to enable the user to monitor movement of water, gas and/or oil interfaces during injection of a fluid into the formation.

In another embodiment, the information of the tomography of water, gas and/or oil interfaces may be transmitted chronologically.

Also, the stimulation method as described above may further comprise the step of transmitting the information of the tomography of water, gas and/or oil interfaces to the user real-time.

Furthermore, the stimulation method as described above may comprise the step of controlling the preselected range of frequencies or a single frequency in which the mechanical wave activation device is activated depending on the information received by the user of the tomography of water, gas and/or oil interfaces, so that the preselected range of frequencies or a single frequency may be increased if the information on the tomography of water, gas and/or oil interfaces shows that the oil or gas in the monitored part of the formation moves slower than a predetermined value, or the preselected range of frequencies or a single frequency may be decreased if the information on the tomography of water, gas and/or oil interfaces shows that the oil or gas in the monitored part of the formation moves faster than a predetermined value.

Moreover, the stimulation method as described above may further comprise the steps of:

arranging a plurality of mechanical wave activation devices for transmitting mechanical waves in a plurality of peripheral injection and/or production wells, said peripheral injection and/or production wells encircling at least one production well and/or at least one injection well suitable for the application, arranging at least one mechanical wave activation device for transmitting mechanical waves in at least one central injection or production well, said at least one central injection or production well being encircled by the plurality of peripheral injection or production wells, injecting a pressurised fluid into the formation from the plurality of peripheral injection wells towards the at least one production well, activating the mechanical wave activation device with a preselected range of frequencies or a single frequency, receiving the mechanical waves transmitted by the plurality of mechanical wave activation devices through the formation by the mechanical wave sensors, and creating a tomography of water, gas and/or oil interfaces in the part of the formation situated between the mechanical wave activation device in the injection and/or production wells and the mechanical wave sensor in the at least one injection and/or production well from the mechanical wave received by the plurality of mechanical wave sensors arranged in the at least one injection and/or production well.

In addition, the stimulation method as described above may comprise the steps of:

transmitting information to the user of the tomography of water, gas and/or oil interfaces in the part of the formation situated between the mechanical wave activation device in the peripheral injection and/or production wells and the mechanical wave sensor in the at least one injection and/or production well in order to enable a user to monitor movement of water, gas and/or oil interfaces during injection of the fluid from the peripheral injection wells, and determining when a water, gas, or oil interface during injection of the fluid from the peripheral injection wells has passed the at least one central injection well.

Also, the stimulation method as described above may comprise the step of injecting a fluid into the formation from the at least one central injection well towards the at least one production well.

Furthermore, the stimulation method as described above may comprise the step of arranging the mechanical wave activation device in the at least one central injection or production well.

In said method, a tool having a receiving unit may enter the production well for receiving information from the mechanical wave sensor from which information of the tomography of water, gas and/or oil interfaces may be derived.

The stimulation method as described above may further comprise the step of activating the mechanical wave activation device arranged in the injection and/or production wells in a predetermined pattern to optimise the creation of a tomography of the water, gas and/or oil interfaces.

Moreover, the stimulation method as described above may further comprise the step of arranging a plurality of mechanical wave sensors in one or more of the injection and/or production wells.

Also, the stimulation method as described above may further comprise the step of creating a three-dimensional representation of the tomography of water, gas and/or oil interfaces in the part of the formation situated between the mechanical wave activation device in the plurality of injection and/or production wells and the mechanical wave sensor in the at least one injection and/or production well from the mechanical waves signals received by the plurality of mechanical wave sensors arranged in the at least one injection and/or production well.

Said mechanical wave sensor may be arranged at several positions along the well.

Further, the mechanical wave sensor may be seismic probes or geophones.

The present invention also relates to a downhole stimulation system for stimulating oil- or gas-containing parts of a formation, comprising:

one or more injection wells, one or more production wells, at least one mechanical wave activation device arranged in at least one injection and/or production wells below a well head or a blowout preventer for transmitting mechanical waves from the one or more injection and/or production wells, and a plurality of mechanical wave sensors arranged in at least one injection or production well for receiving the mechanical waves transmitted from the mechanical wave activation device.

The downhole stimulation system as described above may further comprise a tool having a receiving unit for receiving information from the mechanical wave sensor from which information of a tomography of water, gas and/or oil interfaces may be derived.

Moreover, the mechanical wave activation device may be activated by means of pressurised fluid, explosives or detonations, a motor, a chemical composition or solid fuel.

The perforation gun may be a non-perforating gun comprising non-perforating charges.

Further, the mechanical wave sensors may be seismic probes or geophones.

Finally, the mechanical wave sensor may comprise a communication device so that the mechanical wave sensor can communicate tomography data to a neighbouring mechanical wave sensor.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
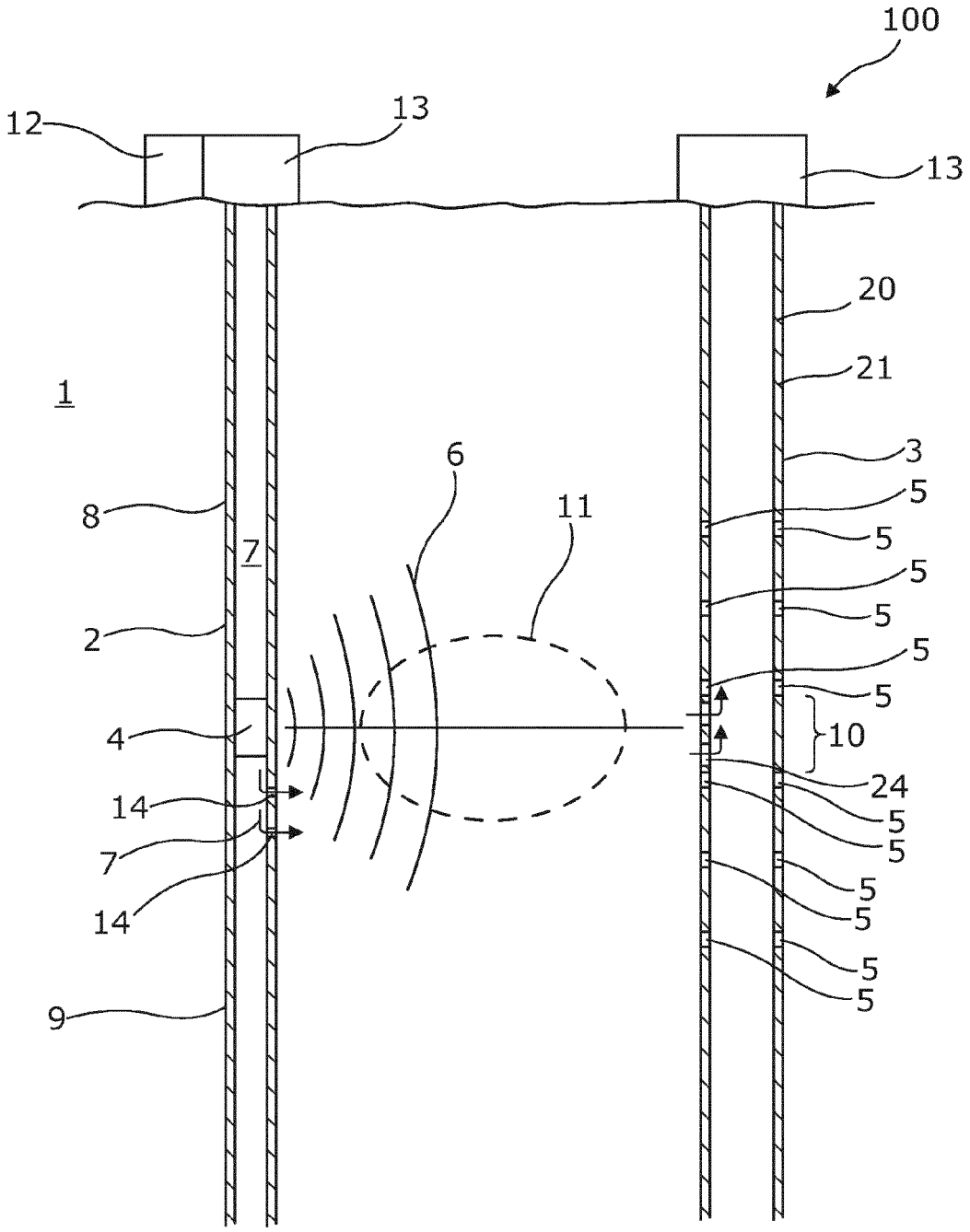
FIG. 1 shows a schematic drawing of a downhole system for carrying out a method according to the invention.

FIG. 1 shows a downhole stimulation system 100 comprising an injection well 2 and a production well 3. The injection well 2 comprises a mechanical wave activation device 4 arranged in the casing of the well, dividing the casing in a first part 8 and a second part 9. The first part of the casing is pressurised with fluid 7 by means of a pump 12 arranged at the well head 13, and the pressurised fluid is converted into mechanical waves 6 by the mechanical wave activation device 4. Having passed the mechanical wave activation device 4, the fluid 7 is injected through injection openings 14 into the formation 1, forcing an oil-containing part 11 in the formation towards the production well 3. The production well 3 comprises several mechanical wave sensors 5 arranged in the wall 20 of the production casing 21. The mechanical wave sensor 5 receives the mechanical waves 6 for creating a tomography of water, gas and/or oil interfaces in the part of the formation situated between the mechanical wave activation device in the injection well 2 and the mechanical wave sensor in the production well 3 from the mechanical waves received by a plurality of mechanical wave sensors arranged in the wall of the casing in the production well 3.

The mechanical waves 6 transmitted by the mechanical wave activation device 4 stimulates the oil field, and by stimulating the oil field with a predetermined frequency, the production is stimulated on a regular basis and not just when the water cut is increasing. The pools of oil, i.e. subsurface oil accumulations such as volumes of rock filled with small oil-filled pores or micro bores, are then affected continuously by the discharged energies and the production of oil from the formation is enhanced. Simultaneously, the low frequency mechanical stimulation initiates micro-fracturing of the formation or even micro-collapses of cavities in the formation, especially in limestone formations but also in sandstone and other types of oil-bearing formations. The micro bores created by the stimulation enable the oil to flow and accumulate in larger pools or areas of oil-containing fluid. By injecting an injection fluid simultaneous to the stimulation of the reservoir by mechanical stimulation, the larger pools or areas of oil-containing fluid may be forced towards production wells close to the injection wells.

Water injection is typically performed to maintain reservoir pressure and thus done to increase the amount of oil which may be extracted from a reservoir. However, at some point, water injection will not be able to force any more oil out of the reservoir, leading to an increase in the water cut. The increase in water cut may originate from the water injection or from water presence close to the reservoir. At this point or even before, mechanical waves, through such part of the formation, may energise the formation so that oil droplets or particles in the formation may gain enough energy to escape surfaces binding the oil droplets or particles in the formation, thereby allowing them to be dissolved in the free-flowing fluids in the formation, e.g. injection fluid. This may further increase the oil production in the reservoir, leading to an increase in the oil content of the fluid in the production wells. At very high energies of the mechanical waves or when exposed to certain mechanical waves within certain frequency ranges, e.g. at Eigen frequencies of the combined well-formation system, the formation may be forced to crack, fracture or splinter, allowing oil droplets or particles to escape closed oil pools, closed micro bores in the formation or other closed cavities in the formation, thereby increasing the content of oil in the oil-containing fluid.

By having mechanical wave sensors 5 in the production well 3 as shown in FIG. 1, the mechanical waves 6 produced for stimulating the reservoir are furthermore used for creating a tomography of the formation surrounding the production well 3. The mechanical wave activation device 4 is thus both used for stimulating the oil reservoir and as a seismic source in order to create a tomography of the oil-containing part surrounding the production well 3. The production well 3 comprises a production zone 10 having inflow valves 24 for letting fluid from the reservoir into the production well 3. By using the mechanical wave activation device 4 as seismic sources, the oil production is not temporarily stopped for insertion of a seismic sensor 5 inside the production well 3 (not in the wall) in order to obtain knowledge of the content of the formation surrounding the production well 3 in order to control the production and the injection. With a view to optimising the production, knowledge of the content of the formation surrounding the production well 3 is very important, and not just the control of the production based upon water cut measurements. In the present invention, the sensors are permanently present in the walls of the casing in the production well, and such measurements can be performed without the production having to be stopped. However, should the seismic sensors have to be inserted inside the production well 3, such information is not gained that often as the production is thus stopped. By injecting a fluid into the formation from the one or more injection wells towards the one or more production wells, a dynamic tomography of the formation and fluids in the formation may be constructed from the received signals, either continuously or as often as required and without having to temporarily stop the production.

Figure 2:
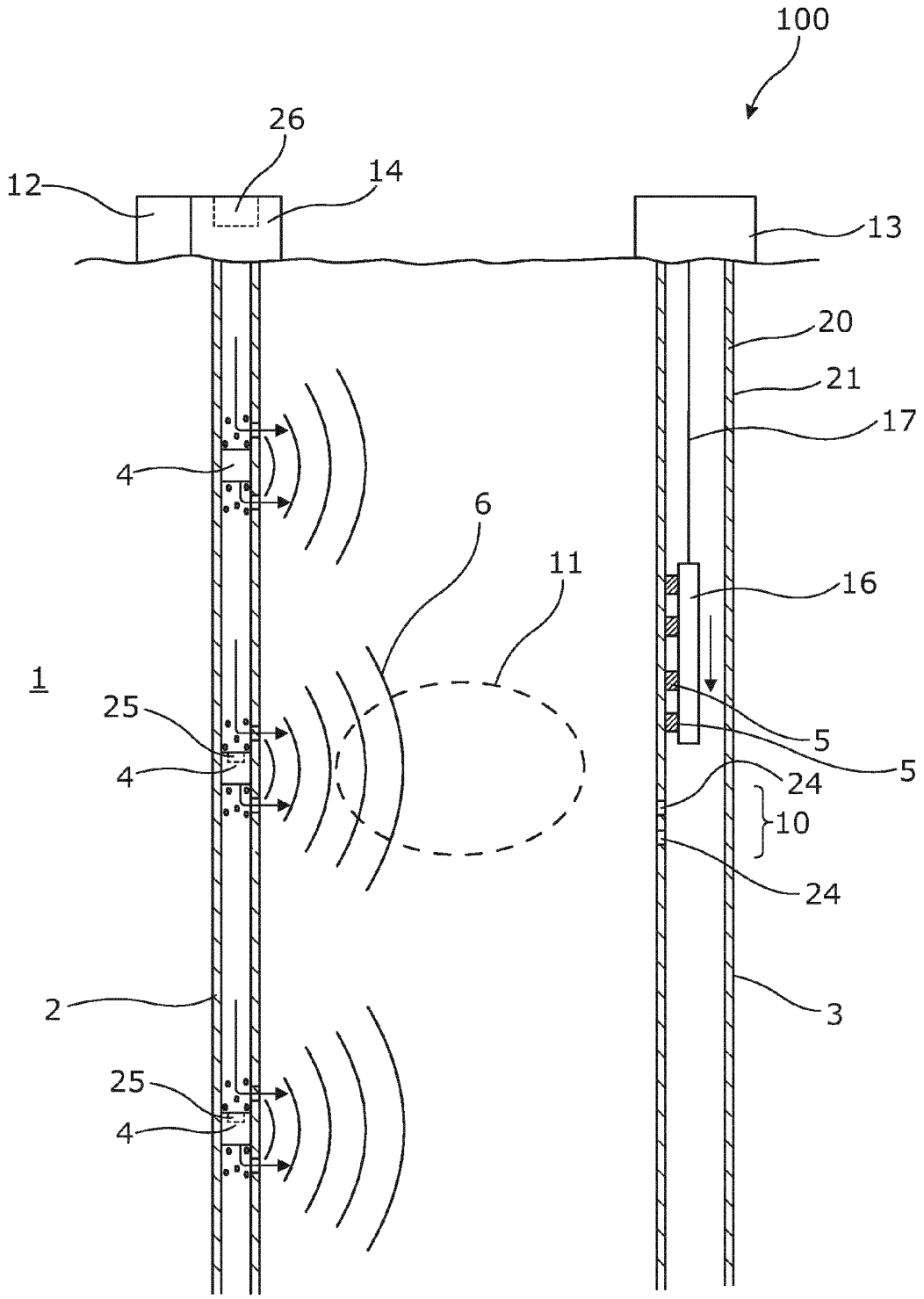
FIG. 2 shows a schematic drawing of another embodiment of the downhole system for carrying out a method according to the invention.

As shown in FIG. 2, the mechanical wave sensor 5 of the production well 3 comprises a communication device 25 so that the mechanical wave sensor 5 can communicate tomography data to a neighbouring mechanical wave sensor 5 and so forth all the way up to the sensor arranged nearest to the well which communicates with a control unit 26 at the well head via a communication line, wirelessly or by means of mud waves.

In FIG. 2, several mechanical wave activation devices 4 are arranged in the same injection well 2 transmitting mechanical waves into the formation in order to stimulate the production and improve the mobility of the oil-containing fluid in the formation. The production well 3 comprises a sensor tool 16 submerged via a wireline 17. The sensor tool 16 comprises the mechanical wave sensor 5 in order to receive the mechanical waves 6 for providing a tomography of the received mechanical wave signals and thus gain information of the water, gas and/or oil interfaces in the part 11 of the formation situated between the injection and production wells.

Well-to-well seismic imaging methods may provide images of the formation structure and fluids between wells in the form of mechanical wave reflection sections showing acoustic impedance contrasts or in the form of velocity models obtained by converting arrival times of known mechanical waves according to a model (transmission tomography). The mechanical wave activation devices may also transmit pulses of electromagnetic radiation.

The injected fluid may be any kind of suitable fluid, such as water or gas. The gas may be methane or carbon dioxide or other miscible or immiscible gasses. The injected fluid may have a higher temperature at the point of injection than the formation. By activating the oil field continuously with hot fluid, the oil-containing fluid changes density to a lower density and the mobility of the oil-containing fluid is thus substantially increased. The mobility is increased both by the vibrations and by the density change, causing the oil-containing fluid to accumulate in larger areas or pools in the formation, such as sandstone or limestone.

Figure 3:
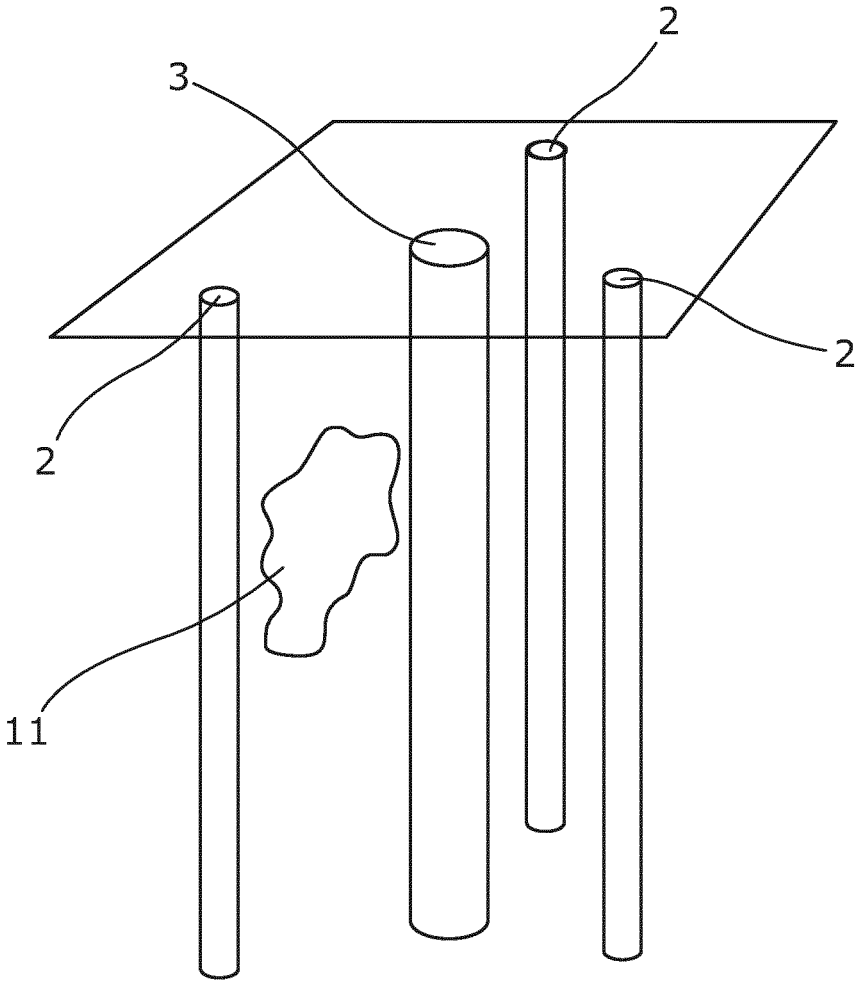
FIG. 3 shows a perspective view of an oil field comprising three injection wells and one production well centred between said injection wells.

By activating the oil field continuously from various injection or production wells as shown in FIG. 3, the oil-containing fluid is helped to accumulate in larger areas. Furthermore, the energy discharge creates micro bores in the formation in areas where a pressure gradient is present, and thus helps the oil-containing fluid trapped in pockets to flow and accumulate into larger areas of oil-containing fluid. In an oil field comprising several injection wells 2 where mechanical wave activation device in the form of a downhole perforation gun, a fluid-activated gun, a chemical reaction guns or a solid fuel gun are already present, the mechanical wave activation device is simultaneously used as a transmitter of acoustic signal. And just by inserting a tool having mechanical wave sensor, a tomography can be created providing information of the water, gas and/or oil interfaces in the part 11 of the formation situated between the injection wells 2 and production well 3. Subsequently, the production and injection is adjusted according to the information in order to optimise the production.

The mechanical wave activation device is controlled to discharge energy in a predetermined pattern determining in which injection well the mechanical wave activation device is activated. Some of the mechanical wave activation device may be activated more than others, and some may even be activated on the same day. The mechanical wave activation device being activated more than some of the others is/are the first mechanical wave activation device determined as being nearest to the production well in which the water cut is increasing.

When the water cut is increasing, the mechanical wave activation devices are activated more frequently in the predetermined pattern or the pattern is changed. If the water cut still increases, the pattern is changed so that the activation device nearest to the production well, in which the water cut is increasing, is activated more frequently than others, or the pattern is maintained and the frequency is increased until the water cut is decreasing again.

Figure 4A:
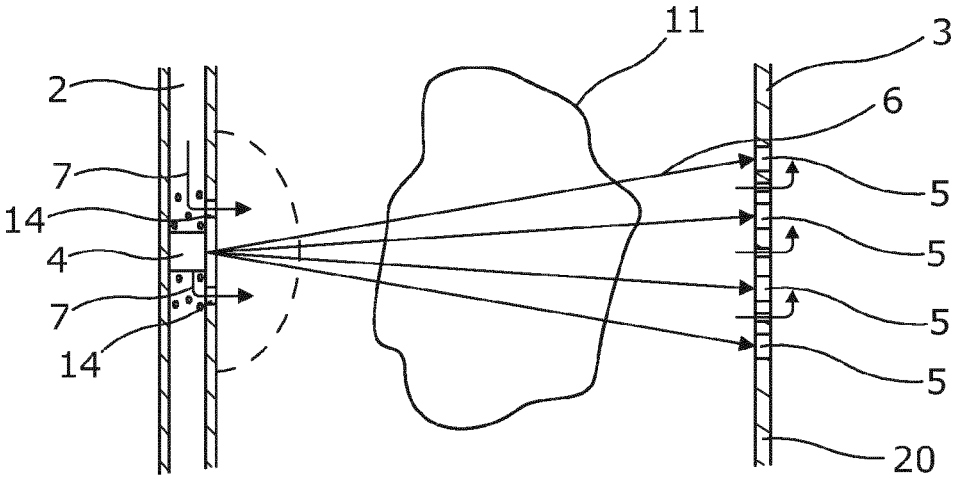
FIGS. 4*a*-4*c* show cross-sectional views of an oil-containing reservoir during injection of an injection fluid.

In FIG. 4*a*, the mechanical wave activation device 4 transmits mechanical wave signals 6 for one injection well 2, and a plurality of mechanical wave sensor 5 is arranged in the casing wall 20 of the production well for receiving the mechanical wave signals transmitted from the mechanical wave activation device 4. By activating the mechanical wave activation device with a preselected frequency downhole, a set of signals is provided by transmitting one or more mechanical waves from mechanical wave activation device through the subsurface formation and receiving signals emanating from the subsurface formation in response to the mechanical waves with the mechanical wave sensors in the one or more production wells. From the received signals a tomography of water, gas and/or oil interfaces in the part of the formation situated between the injection and production wells may be created.

Figure 4B:
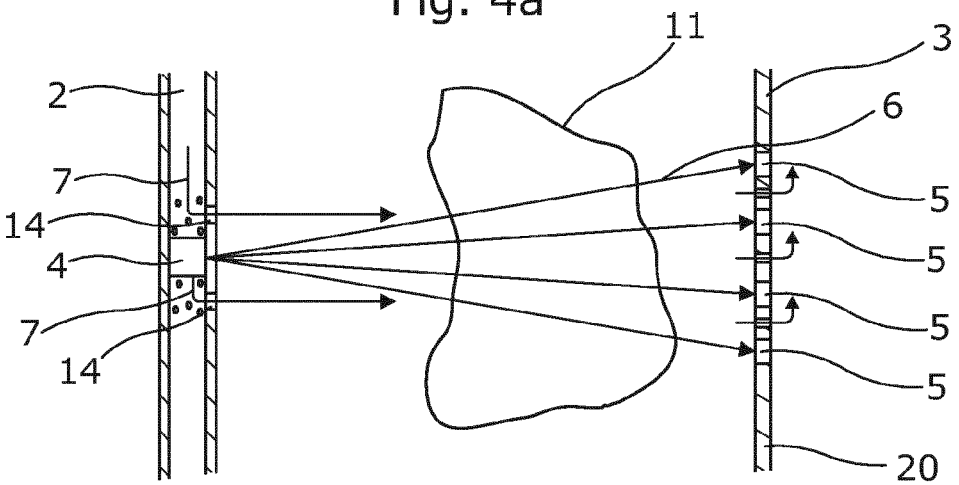
Figure 4C:
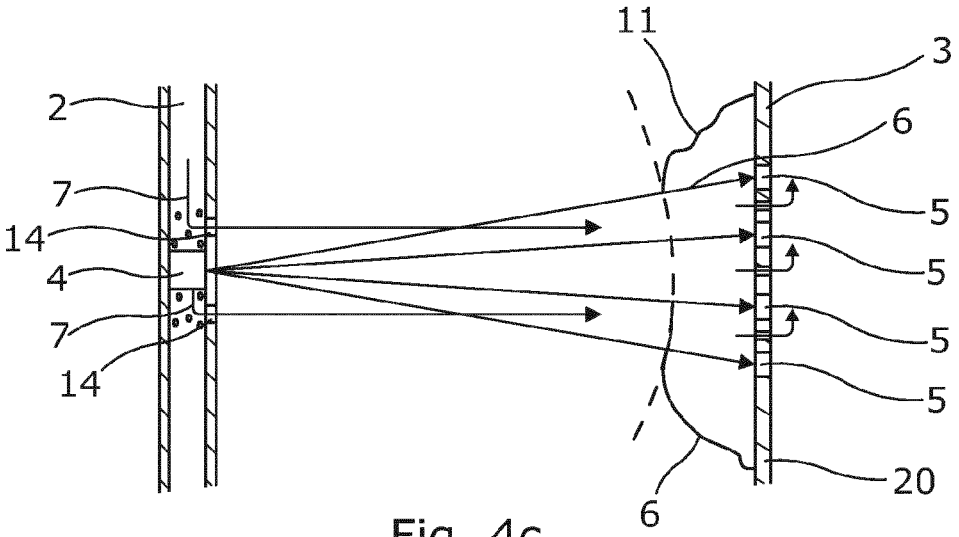

When injecting fluid into the formation, the oil-containing area 11 is driven towards the production well 3 as shown in FIG. 4*b* while the mechanical wave signals 6 propagate through the formation and are received in the mechanical wave sensor 5 for providing a tomography of water, gas and/or oil interfaces in the part of the formation situated between the injection and production wells. In FIG. 4*c*, the oil-containing area 11 has been driven even further towards the production well 3 by the injection fluid 7 while still using the vibrations of the mechanical wave activation device 4 to provide a tomography of water, gas and/or oil interfaces in the part of the formation between the injection and production wells.

The mechanical wave activation device 4 arranged in the injection wells and/or production well may be activated with a frequency of once within a period of 1-365 days, preferably once within the period of 1-185 days, more preferably once within the period of 1-90 days, even more preferably once within the period of 1-30 days, and even more preferably once within the period of 5-20 days, and with an energy discharge of at least 0.1 kilograms TNT (trinitrotoluene) equivalence per activation, preferably at least 0.5 kilograms TNT equivalence per activation, more preferably at least 1 kilograms TNT equivalence per activation, even more preferably at least 5 kilograms TNT equivalence per activation.

Thus, the activation device may be a downhole perforation gun, a fluid-activated gun, a seismic source, a chemical reaction gun or a solid fuel gun. The perforation gun may comprise non-perforating charges and thus be a non-perforating gun. The gun may also be an electromagnetic hammer.

The fluid-activated gun may be a gas-activated gun, and thus the injection fluid is gas, such as methane gas or carbon dioxide. In one embodiment, the gas accumulates in a piston chamber in the gun, driving a piston in one direction in the chamber compressing a spring, and when the spring cannot be compressed any further, a release mechanism is activated and the piston moves at a high velocity in the opposite direction, hammering into the back wall of the chamber, creating the mechanical waves. In another embodiment, the gas gun is activated by pulsed injection fluid, creating the hammering effect to generate the mechanical waves.

The chemical reaction gun is a gun in which at least two chemicals react to vaporise and thus provide mechanical waves travelling into the formation. The chemicals may be sent down in two flow lines, each supplying a chemical which is mixed in the gun. The chemicals may be the two gases oxygen and methane or the fluids potassium permanganate and dichromate. One or all of the chemicals that are to react may also be present in the gun from the beginning, working as an oxidant, such as potassium dichromate or potassium permanganate, that may be activated using another chemical, and thereby, in a controlled process, release energy and a rapidly expanding gas. Hydrocarbon-based fuels, such as gasoline, gasoil or diesel may also be used as reagents and be supplied through a flowline.

The solid fuel gun comprises solid fuel, such as charcoal, graphite or cordite, and potassium nitrate or sodium nitrate.

The solid fuel may also be mixed with sulphur. The solid fuel gun is ignited by arc ignition.

In the event that the tools or the mechanical wave activation devices are not submergible all the way into the casing, a driving unit such as a downhole tractor can be used to push the tools all the way into position in the well. A downhole tractor is any kind of driving tool capable of pushing or pulling tools in a well downhole, such as a Well Tractor®. The downhole tractor comprises wheels arranged on retractable arms.

By a casing is meant any kind of pipe, tubing, tubular, liner, string etc. used downhole in relation to oil or natural gas production.

Although the invention has been described in the above in connection with preferred embodiments of the invention, it will be evident for a person skilled in the art that several modifications are conceivable without departing from the invention as defined by the following claims.

The invention claimed is:

1. A method for improving fuel collection from an underground deposit comprising stimulating at least a first fuel-containing section of an underground formation, the at least first section being situated between at least one first well and a second well, the at least one first well being either an injection well or a production well and the second well being either an injection well or a production well, the method comprising:

providing at least one mechanical wave generation device downhole within at least the at least one first well;

arranging at least a first mechanical wave sensor in at least the second well, the first mechanical wave sensor being configured to receive and interpret mechanical waves transmitted from the at least one mechanical wave generation device;

injecting a pressurised fluid into the formation from at least one injection well of the at least one first well and the second well in a direction towards a production well of the at least one first well or the second well;

activating the at least one mechanical wave generation device downhole to project a preselected range of frequencies or single frequency into the formation after or simultaneously with injecting the pressurised fluid into the formation;

receiving the mechanical waves transmitted by the at least one mechanical wave generation device through the formation via the at least first mechanical wave sensor; and creating a tomography of water, gas, and/or oil interfaces in the at least first section of the formation using data gathered by the at least first mechanical wave sensor.

2. The method according to claim 1, wherein the at least one mechanical wave generation device generates a mechanical wave by utilizing the group consisting of pressurised fluid, explosives detonations, a motor, a chemical composition, and solid fuel.

3. The method according to claim 1, wherein the at least one mechanical wave generation device is selected from the group consisting of a downhole perforation gun, a fluid-activated gun, a seismic source, a chemical reaction gun, and a solid fuel gun.

4. The method according to claim 1, further comprising transmitting information to a user regarding the tomography of water, gas and/or oil interfaces in the at least first section in such a way as to enable the user to monitor movement of water, gas and/or oil interfaces during injection of a fluid into the formation.

5. The method according to claim 4, further comprising controlling a preselected range of frequencies or a single frequency depending on the information received by the user regarding the tomography of water, gas, and/or oil interfaces, wherein the preselected range of frequencies or the single frequency is increased if the information on the tomography of water, gas and/or oil interfaces indicates that oil or gas in the monitored part of the formation is moving slower than a predetermined value, and/or the preselected range of frequencies or the single frequency is decreased if the information on the tomography of water, gas, and/or oil interfaces indicates that the oil or gas in the monitored part of the formation is moving faster than a predetermined value.

6. The method according to claim 1, wherein said at least one first well comprises a plurality of first wells and the method further comprises:

arranging a plurality of mechanical wave generation devices configured to transmit mechanical waves in the plurality of first wells, respectively, said first wells encircling at least the second well, the second well being centrally located relative to the plurality of first wells;

injecting a pressurised fluid into the formation from a plurality of injection wells towards the production well, activating the plurality of mechanical wave generation devices with a preselected range of frequencies or a single frequency, receiving the mechanical waves transmitted by the plurality of mechanical wave generation devices through the formation via the at least one mechanical wave sensor; and creating a tomography of water, gas and/or oil interfaces in the at least first section of the formation.

7. The method according to claim 6, further comprising:

transmitting information to a user regarding the tomography of water, gas and/or oil interfaces in the at least first section of the formation in such a way as to enable a user to monitor movement of water, gas and/or oil interfaces during injection of the fluid from the injection wells, and determining when a water, gas, or oil interface during injection of the fluid from the injection wells has passed the at least one first or second well.

8. The method according to claim 6, wherein at least one third well comprising a central injection well is provided within the formation encircled by the first wells, further comprising:

injecting a fluid into the formation from the at least one third well towards the production well.

9. The method according to claim 8, further comprising arranging a mechanical wave generation device in the second well or the at least one third well.

10. The method according to claim 6, further comprising activating the plurality of mechanical wave generation devices arranged in the plurality of first wells in a predetermined pattern to optimise the creation of a tomography of the water, gas and/or oil interfaces.

11. The method according to claim 1, wherein a tool having a receiving unit enters the production well for receiving information from the at least first mechanical wave sensor from which information regarding the tomography of water, gas and/or oil interfaces may be derived.

12. The method according to claim 1, further comprising creating a three-dimensional representation of the tomography of water, gas and/or oil interfaces in the first section of the formation.

13. The method according to claim 1, wherein the at least one injection well from which injection fluids are pumped into the formation is a first well.

14. The method according to claim 1, wherein the production well towards which injection fluids are pumped is a second well.

15. The method according to claim 1, wherein the production well is at a distance which traverses the formation from the injection well.

16. A downhole stimulation system for stimulating oil- or gas-containing parts of a formation, comprising:

at least a first well, the first well being an injection well or a production well;

at least a second well, the second well being a production well or an injection well;

at least one mechanical wave generation device, the at least one mechanical wave generation device being arranged downhole within at least the first well; and at least a first mechanical wave sensor arranged in the at least second-well configured to receive mechanical waves transmitted from the at least one mechanical wave generation device;

wherein:

the at least one mechanical wave generation device is configured to project a mechanical wave into the formation such that the wave comes into contact with and passes through the oil- or gas-containing parts of the formation located between the at least first well and the at least second well; and the at least one mechanical wave generation device is configured to be activated after or simultaneously while injection fluid is pumped into the formation.

17. The downhole stimulation system according to claim 16, further comprising a tool having a receiving unit for receiving information from the at least first mechanical wave sensor from which information of a tomography of water, gas and/or oil interfaces may be derived.

18. The downhole stimulation system according to claim 16, wherein the at least one mechanical wave generation device generates the mechanical wave by utilizing the group consisting of pressurised fluid, explosives detonations, a motor, a chemical composition, and solid fuel.

19. The downhole stimulation system according to claim 16, wherein the at least one mechanical wave generation device is selected from the group consisting of a downhole perforation gun, a fluid-activated gun, a seismic source, a chemical reaction gun, and a solid fuel gun.

20. The downhole stimulation system according to claim 16, wherein the at least one mechanical wave generation device is a non-perforating gun comprising non-perforating charges.

21. The downhole stimulation system according to claim 16, wherein at least the first mechanical wave sensor is a seismic probe or a geophone.

22. The downhole stimulation system according to claim 16, wherein at least the first mechanical wave sensor comprises a communication device so that at least the first mechanical wave sensor can communicate tomography data to a neighbouring mechanical wave sensor.

* * * * *